US011009209B2

(12) United States Patent
Potter

(10) Patent No.: US 11,009,209 B2
(45) Date of Patent: May 18, 2021

(54) LIGHTING ADJUSTMENT AID

(71) Applicant: Valeo Vision SAS, Bobigny (FR)

(72) Inventor: Brant Potter, Seymour, IN (US)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/860,388

(22) Filed: Apr. 28, 2020

(65) Prior Publication Data

US 2021/0102678 A1 Apr. 8, 2021

Related U.S. Application Data

(60) Provisional application No. 62/912,267, filed on Oct. 8, 2019.

(51) Int. Cl.

| | |
|---|---|
| ***F21S 41/33*** | (2018.01) |
| ***F21S 41/657*** | (2018.01) |
| ***F21S 41/148*** | (2018.01) |
| ***F21Y 115/10*** | (2016.01) |

(52) U.S. Cl.

CPC ..... *F21S 41/337* (2018.01); *F21S 41/148* (2018.01); *F21S 41/657* (2018.01); *F21Y 2115/10* (2016.08)

(58) Field of Classification Search

CPC ..... F21S 41/337; F21S 41/657; F21S 41/148; F21S 41/33; F21S 41/335; F21S 41/147; F21V 7/09; F21V 7/048; F21V 7/041; F21Y 2115/10

See application file for complete search history.

(56) References Cited

U.S. PATENT DOCUMENTS

| | | | | |
|---|---|---|---|---|
| 4,236,099 | A | 11/1980 | Rosenblum | |
| 6,040,787 | A | 3/2000 | Durham | |
| 6,483,441 | B1 | 11/2002 | Hinde | |
| 6,527,424 | B2 * | 3/2003 | Rosenhahn | B60Q 1/1415 362/513 |
| 7,959,336 | B2 * | 6/2011 | Iwasaki | F21S 41/365 362/517 |
| 9,719,650 | B2 * | 8/2017 | Kinouchi | F21S 41/336 |
| 2002/0130953 | A1 | 9/2002 | Riconda et al. | |
| 2005/0099821 | A1 | 5/2005 | Potter et al. | |
| 2005/0134482 | A1 | 6/2005 | Li | |
| 2013/0286672 | A1 * | 10/2013 | Godecker | F21S 41/657 362/466 |
| 2018/0142859 | A1 * | 5/2018 | Watanabe | F21S 41/43 |

* cited by examiner

*Primary Examiner* — Peggy A Neils

(74) *Attorney, Agent, or Firm* — Young Basile Hanlon & MacFarlane, P.C.

(57) ABSTRACT

A light assembly comprising: (a) one or more light sources; and (b) one or more reflectors comprising: (i) a first reflector facet that forms a first reflected light by redirecting light from the one or more light sources in a first direction and (ii) a second reflector facet that forms a second directed light by redirecting light from the one or more light sources in a second direction; and wherein the first directed light and the second directed light are configured to extend away from a vehicle housing the light assembly to form a light pattern that demonstrates a location the light assembly is aimed relative to the vehicle.

19 Claims, 6 Drawing Sheets

LIGHTING ADJUSTMENT AID

CROSS-REFERENCE TO RELATED APPLICATIONS

This application claims priority to and the benefit of U.S. Provisional Application Patent Ser. No. 62/912,267, filed Oct. 8, 2019, the entire disclosure of which is hereby incorporated by reference.

FIELD

The present teachings relate to a light source of a vehicle, and specifically a light source that includes an aid that assists a user in aiming the light source.

BACKGROUND

Headlights in vehicles typically are static in position and once aimed maintain the aim. However, as vehicles move an adjustment of the light may change over time so that the lights are directed outside of a desired location. It also may be difficult for an operator of a vehicle to determine that the lights are misaligned; however, the misalignment may be apparent to or directed toward surrounding vehicles or individuals.

Examples of lights or light systems may be disclosed in U.S. Pat. Nos. 4,236,099; 6,483,441; and 6,040,787 and US Publication Nos. 2002/0130953; 2005/0099821; and 2005/0134482 all of which are expressly incorporated herein by reference for all purposes. Thus, there is a need for a device that assists in aiming light from a light source. It would be desirable to method and device for aiming each individual light individually. There is a need for a device and method of determining a direction a light source is projecting and aligning the light source. It would be desirable to be able to aim each individual light of a vehicle.

SUMMARY

The present teachings provide: a light assembly comprising: (a) one or more light sources; and (b) one or more reflectors comprising: (i) a first reflector facet that forms a first reflected light by redirecting light from the one or more light sources in a first direction and (ii) a second reflector facet that forms a second directed light by redirecting light from the one or more light sources in a second direction; and wherein the first directed light and the second directed light are configured to extend away from a vehicle housing the light assembly to form a light pattern that demonstrates a location the light assembly is aimed relative to the vehicle.

The present teachings provide: a light system comprising: (a) two or more light assemblies each comprising: (i) light sources that directly or indirectly project light so that the light: (1) extends in a first direction; (2) extends in a second direction so that the light extending in the first direction and the light extending in the second direction form one or more light patterns indicating an orientation of each of the two or more light assemblies relative to a vehicle configured to house the light system; and (3) extends in a primary direction that is different from the first direction and the second direction.

The present teachings provide: a method comprising: (a) directing light from light assemblies of a light system away from a vehicle to a surface extending substantially perpendicular to a ground plane; (b) locating a light pattern formed by the light assemblies on the surface; and (c) moving the light assemblies so that the light pattern is moved to an aimed position.

The present teachings provide a device that assists in aiming light from a light source. The present teachings provide a method and device for aiming each individual light individually. The present teachings provide a device and method of determining a direction a light source is projecting and aligning the light source. The present teachings provide a light system where each individual light of a vehicle is aimable separately.

DETAILED DESCRIPTION

Figure 1A:
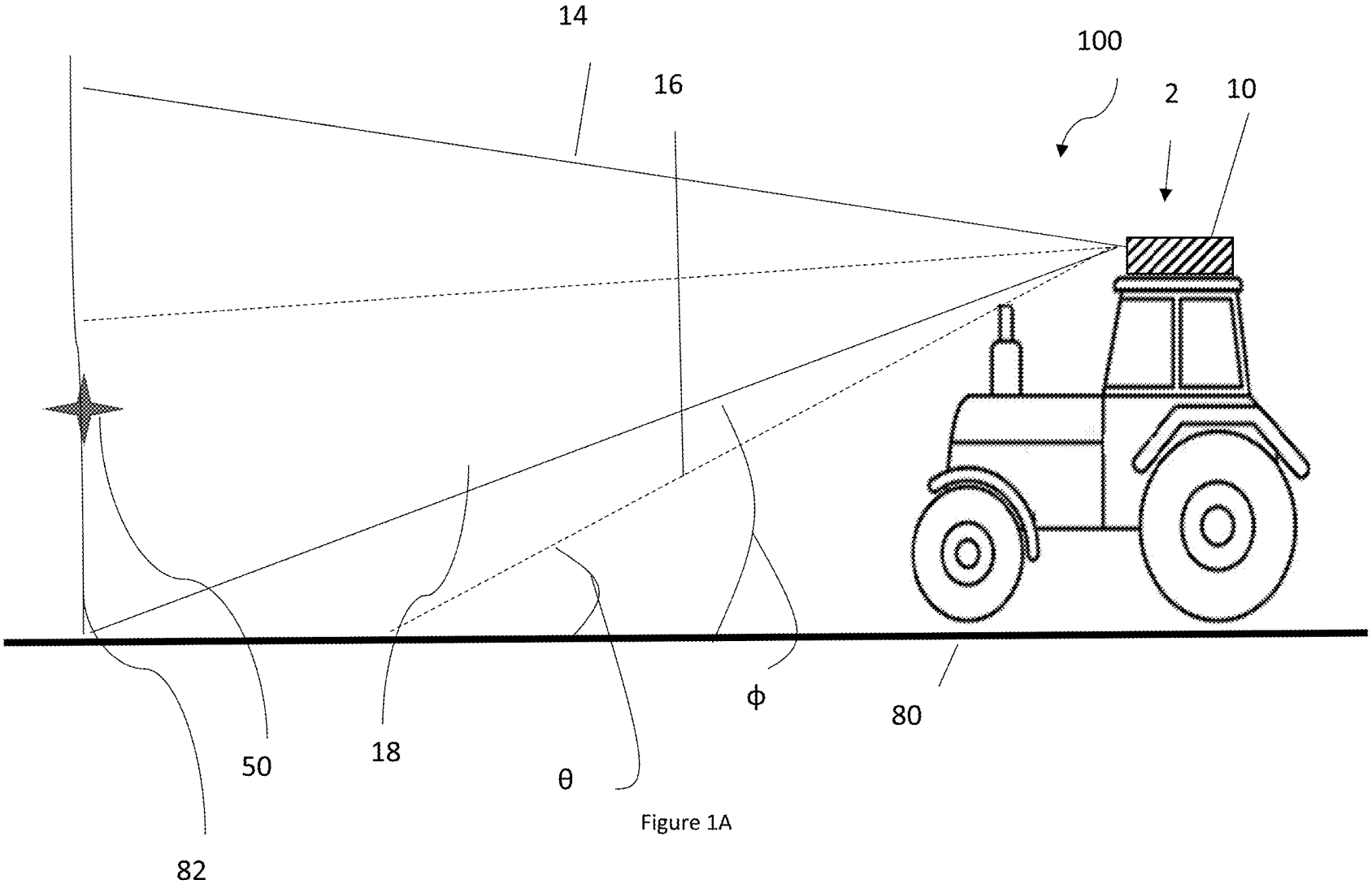
FIG. 1A is a side view of a vehicle with a light being directed in two locations.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a light system. The light system is located with a vehicle. Preferably, the light system is part of a car, motorcycle, bus, truck, semi-truck, SUV, XUV, four-wheeler, dirt bike, tractor, combine, heavy equipment, farm equipment, industrial equipment, commercial equipment, or a combination thereof. The light system may project in a forward direction, rear direction, side direction, or a combination thereof. Preferably, the light system projects a light from an external surface of the vehicle to a location in front of the vehicle. The light system may direct some light at the ground. The light system may direct some light above the ground. The light system may be integrated into a front end, a rear end, or both of a car. The light system may project light out of the vehicle. The light source may include lights and optical elements. The light system may include one or more light assemblies and preferably a plurality of light assemblies.

The light assembly may function to direct light so that a predetermined region is illuminated. The light assembly may be located in a front or a rear of a vehicle. The light assembly may be located in a corner region, a central region, or both of vehicle. Preferably, the light assemblies are headlights for a vehicle. The light assembly may be a plurality of components that when combined together generate light and project the light in a predetermined pattern to a predetermined location or in a predetermined direction. The light assembly may include one or more printed circuit boards (PCB), one or more light sources, one or more reflectors, one or more collimators, or a combination thereof. Each light assembly may include one or more light sources and preferably a plurality of light sources.

The light sources function to produce light. The light source may be a device or plurality of devices that create light and the light extends outward from the light source. The light source may produce a high beam, a low beam, a blending beam, or a combination thereof. The light source may be aimed for near light, far light, blending light that blends the far light and near light together, or a combination thereof. The light source may comprise a plurality of lights. For example, the light source may have a first light that is directed to the first reflector facet, a second light that is directed to the second reflector facet, a third light that is directed to the primary reflector facet, and fourth light that is directed to the blended reflector facet. In another example, a single light source may direct light to the first reflector facet, the second reflector facet, the primary reflector facet, and the blended reflector facet. The light source may be any type of lighting device that produces light such as an incandescent bulb, fluorescent light, compact fluorescent lamp, halogen lamp, light emitting diode (LED), high intensity discharge lamps (HID); halogen lights, xenon lights, or a combination thereof. The light source may be a single lamp or bulb. Preferably, the light source includes a plurality of lamps, bulbs, diodes, or a combination thereof. The light source may be an array. The light source may include two or more, 5 or more, 10 or more, 20 or more, or even 50 or more devices that produce light and combine together to form the light source. The light source may include 500 or less, 300 or less, or 200 or less devices that produce light. For example, if the light source is a 10×10 array of light devices some of the 100 devices may be selectively turned on and off, dimmed, brightened, or a combination thereof. The light source may be static. The light source may be free of movement. The light source may be fixed. The light sources may be static and may be manually or physically adjusted so that the light sources are directed to a desired location. The light source may be fixed and the light from the light source may be moved, bent, directed, or a combination thereof by optical elements or reflectors. Each device of the light source may be turned on an off. The light source may direct light above a driving surface (e.g., some light may contact and illuminate the driving surface by a center of the light may be located above the driving surface). The light source may be directed substantially parallel to the light surface (e.g., ground). For example, a center of the light, an axis of the light, or both may extend parallel to the driving surface. The light source may extend along an axis or may be directed away from the axis. The light source may be directed directly out of the vehicle. The light source may be directed in a first direction and then reflected in a second direction to produce a lighted region (e.g., far light, near light, blended light).

The far light may function to extend outward so that a region in a distance is illuminated. The far light may substantially extend above the ground (e.g., 75 percent or more, 80 percent or more, or even 90 percent or more of the light may be contact the ground). The far light may be produced from a first light source or a first group of light sources. The far light may be light reflected from a region of a reflector. The far light may be reflected from an upper region of a reflector. The far light may be "brights" of a vehicle. Far light may have a greater light intensity compared to the near light. Light from a light source may reflect from a reflector to create the far light and light from another light source may reflect from a reflector to create near light.

The near light may function to extend outward so that a portion of ground proximate to a vehicle is illuminated and a region proximal of the far light is illuminated. The near light may extend from the vehicle so that substantially all of the light contacts the ground (e.g., 75 percent or more, 80 percent or more, or even about 90 percent or more). The near light may be produced from a different light source than the far light. The near light and the far light may be produced from the same light source or group of light sources. The near light may reflect from a same reflector as the far light. The near light may reflect from a different reflector as the far light. The near light may reflect from a bottom portion of a reflector (e.g., bottom ⅔, bottom half). The near light and the far light may converge and blended light may overlap a portion of the near light and the far light.

The blended light may function to may function to hide a region between near light and far light. The blended light may be near light and far light that are overlapped. The blended light may be formed by a same light source as the near light, the far light, or both. The blended light may be reflected from a same reflector as the near light, the far light, or both. The blended light may be reflected from a different reflector as the near light and the far light. The blended light may be formed by being shined through a prism or a lens. The blended light may contact a central region of a reflector. The blended light may be reflected from a middle half of a reflector. (e.g., between the near light and the far light). The blended light, the near light, the far light, or a combination thereof may be generated by light sources that are connected to or in communication with a PCB.

The PCBs may function to support, power, control, or a combination thereof one or more light sources. The PCBs may be a single PCB that supports all of the light sources. Each light source may include or be connected to a PCB. Each light type may be connected to or include a PCB. For example, the near light, far light, and blended light may each include a discrete PCB. The PCB may assist in supporting a light source within the light assembly or light system. The PCB may aim the light source. The PCB may aim light from a light source out of a collimator. The PCB may aim light from a light source towards a reflector. The PCB may be fixed relative to a collimator, a reflector, light sources, or a combination thereof.

The reflector functions to direct light to a predetermined location, in a predetermined direction, or both. The reflectors may direct light from the light sources so that near light, far light, blended light, or a combination thereof are directed outward from the light system. The reflector may intensify light from the light sources. The reflector may form a predetermined light pattern. The reflector, the light source, PCB, or a combination thereof may all be aligned relative to each other so that a light pattern is created. The light pattern may be determined based upon the shape of the reflector. Multiple reflectors may be combined together to create a predetermined light pattern. The reflector may have one or more facets. The reflector may have a plurality of facets. Each of the plurality of facets may direct or reflect light to a different location. The facets may create an array of light.

The array of light may cover a spectrum of area. The reflector may have a first reflector facet, a second reflector facet, a primary reflector facet, a blended reflector facet, or a combination thereof.

The reflector facets may function to redirect light to a predetermined location. Some or all of the reflector facets function to create a shape or indication of direction of the reflected light. The reflector facets may direct light onto the ground, above the ground, or both. The reflector facets may reflect light from a light source outward from a vehicle. The reflector facets may direct light to a predetermined location. Each reflector may be a single reflector. The one or more reflectors may be a single reflector. Each light assembly may include one reflector or a plurality of reflectors. The reflector facets may be a first reflector facet, a second reflector facet, a primary reflector facet, a blended reflector facet, or a combination thereof. The first reflector facet and the second reflector facet may direct light generally to a same location. The first reflector facet may direct light in a first direction. The second reflector facet may direct light in a second direction. The first reflector facet and the second reflector facets may create one or more light patterns. The first direction and the second direction may cross so that the one or more light patterns may be formed or a single light pattern may be formed by the first reflector facet and the second reflector facet. The first reflector facet and the second reflector facet may be located within a same plane. Preferably, the first reflector facet and the second reflector facet extend out of a primary plane as the primary reflector facet, out of a blended plane as the blended reflector facet, or both. The first reflector facet and the second reflector facet may be aimed generally towards each other. The first reflector facet and the second reflector facet may have a generally parabolic shape, may form a concave region therebetween, may have curvature, or a combination thereof. The first reflector facet may be angled inwards towards a center line that extends vertically along the reflector. The second reflector facet may extend inwards towards a center line that extends vertically along the reflector. The first reflector facet, the second reflector facet, or both may extend at an angle relative to each other. The first reflector facet, the second reflector facet, or both may be shaped to aim light to a defined position that is generally along or parallel to an optical axis. The first reflector facet, the second reflector facet, or both may be shaped to receive directed light (e.g., a first directed light and a second directed light) create reflected light (e.g., a first reflected light and a second reflected light respectively).

The directed light functions to extend light from a light source to a reflector. The directed light may be directed away from a region to be illuminated. Directed light may extend in a first direction and reflected light may extend in a second opposite direction. The directed light may be aimed at a reflector. The directed light may be a first directed light, a second directed light, a primary directed light, a blended directed light, or a combination thereof. The directed light may be characterized based upon a location the directed light contacts the reflector. The directed light may contact one or more of the reflector facets. Preferably, the directed light contacts all of the facets of a reflector. More preferably, the directed light illuminates entirely all of the reflector. The directed light may contact the reflector and then be reflected light that extends from the reflector towards a predetermined location or an aimed location.

The reflected light functions to form a light pattern, indicate aiming of the light, indicate aiming of the reflectors or reflector facets, or a combination thereof. The reflected light may illuminate a surface, an object, a location of interest, or a combination thereof. The reflected light may be a first reflected light and a second reflected light. The first reflected light and the second directed light may indicate where reflected light from the light source is aimed. The first reflected light and the second reflected light may extend generally in a same direction. The first reflected light and the second reflected light may cross or intersect. The first reflected light may cross or intersect at a predetermined location. For example, when the light system is located a distance from a wall the light patterns from the first reflected light, the second reflected light, or both may cross or intersect. The distance may be about 1 m or more, about 2 m or more, or about 3 m or more. The distance may be about 50 m or less, about 10 m or less, about 7 m or less, or about 5 m or less. The first reflected light and the second reflected light may extend generally parallel to each other. The first reflected light and the second reflected light may extend generally out of a line of sight of a user when the light assembly is properly aimed. The first reflected light and the second reflected light may be at an upper edge, upper region, or both of the reflected light from the reflector. The first reflected light and the second reflected light may be located at a top of or above a primary reflected light. The first reflected light, the second reflected light, or both may form one or more light patterns.

The light patterns function to illustrate an aiming of the light system, a light assembly, or both. The light patterns may only be visible when the light assembly is mis-aligned; first reflected light, the second reflected light, or both are directed towards a wall; or both. The light patterns may only be an alignment indicator. The light patterns may provide light but the light may not primarily be used to illuminate objects. The light patterns may be any pattern that assists a user in aiming or aligning a light assembly. The light patterns may be formed by being reflected off of a reflector. The light patterns may be formed by being directly projected outward (e.g., within being reflected). The light patterns may be created by a collimator, lens, prism, or a combination thereof. Preferably, the light patterns may be formed by a reflector that also reflects the primary light. The light patterns may be an "X", a square, triangle, lines, rectangles, or a combination thereof. The light patterns may create a single light pattern. The light patterns may be two or more light patterns. The light patterns may assist in aligning up and down, side to side, or both. The light patterns may assist in aligning two or more adjacent light assemblies. For example, if a vehicle has 5 or more light assemblies than the light patterns may all be moved to a predetermined height and then moved to a predetermined distance apart so that the light assemblies are all aligned relative to each other. In another example, a first light or light assembly may be aligned and then the lights or light assemblies on either side may be aligned relative to the first light or light assembly based upon a position of the light patterns. The light pattern may not be visible during normal operation, when the vehicle is moving, or both. Alignment of adjacent light patterns may assist in blending light from two or more lights or light assemblies together. The light patterns may assist in providing a light intensity at a predetermined distance.

The light intensity may be an amount of measured light at a distance from a light source. For example, the light at 10 m may have a measured intensity of 4000 candelas and at 20 m may have an intensity of 250 candelas. The light pattern when aimed may have an intensity so that the light pattern may only be visible when the light assembly is properly aimed. For example, a light intensity directed to the first reflector facet, the second reflector facet, or both may be selected such that the light patterns may be visible at a predetermined distance (e.g., 10 m) and if the light pattern is directed a greater distance or less distance than the predetermined distance, the light pattern may not be visible, may be blurry, may be out of focus, or a combination thereof. The light pattern may assist in adjusting the light intensity of the light source, the light assembly, or both. The light intensity for the first reflected light, the second reflected light, both may be a different intensity than a primary reflected light. The primary reflected light may be reflected from a primary reflector facet that is located adjacent to the first reflector facet, the second reflector facet, or both.

The primary reflector facet function to reflect generally all of the light that illuminates a predetermined location. The primary reflector function to illuminate an area that a driver of a vehicle is looking while the vehicle is traveling in that direction. The primary reflector may be about 50 percent or more, about 60 percent or more, about 70 percent or more, or about 75 percent or more of a surface of a reflector. The primary surface may generally extend within a plane. The primary surface may be curved, concave, have a cupped shape, or a combination thereof. The primary surface may reflect primary directed light into a region.

The primary directed light may be light from a light source that is directed to the primary reflector facet. The primary directed light may contact the primary reflector facet and then be reflected so that a desired location is illuminated. The primary directed light may come from a single light source or a plurality of light sources. The primary directed light may come from a same light source as a first directed light, a second directed light, a blended directed light, or a combination thereof. The primary directed light may contact a primary reflector facet and then become a primary reflected light.

The primary reflected light may function to illuminate objects or a region so that the region is visible to a user. The primary reflected light may illuminate a location in front, behind, along a side, or a combination thereof of a vehicle so that objects a visible to an operator of the vehicle. The primary reflected light may be a low beam, a high beam, or both. The primary reflected light may provide a predetermined intensity of light extending away from a vehicle depending upon a distance the light is aimed. For example, is the primary reflected light is intended for a low beam then the intensity of the reflected light will be less than if the primary reflected light is used for a high beam. The primary reflected light may extend at an angle relative to the ground. Some of the primary light may contact the ground. Some of the primary light may extend above the ground. Some of the primary light extends generally parallel to the ground surface. The angle of the primary reflected light may be about 100 degrees or more, about 125 degrees or more, or about 140 degrees or more. The angle of the primary reflected light may be about 180 degrees or less, about 160 degrees or less, or about 150 degrees or less relative to the ground. For example, light that extends at 180 degrees extends straight out and light that extends at 90 degrees extends straight down to the ground. When more than one primary reflected light or more than one light source is used, a blended light may be used so that dark spots are not visible to a user.

The blended light facet functions to direct light between regions, primary reflected light regions, or both. The blended light facets distribute light to regions of less light than the primary light regions. The blended light facets distribute light between two different light regions. For example, if a high beam and a low beam are being used at a same time the blended light will overlap both beams so that the light from the high beam and the light beam appear uniform. The blended light facet may distribute light over a greater area than the primary light facet. The blended light facet may direct light at a greater angle than a primary light facet. The blended light facet may direct light to an edge or an edge region of light from the primary light facet. The blended light facet may direct light so that transitions between lighted regions are not visible. The blended light fact may receive blended directed light from a same light source as the primary reflected light, the second reflected light, the first reflected light, or a combination thereof.

The blended directed light may be from a different light source as the primary directed light, the first directed light, the second directed light, or a combination thereof. The blended directed light may extend to a reflector, through a prism, through a lens, or a combination thereof. The blended directed light may directly extend to a location of interest. The blended directed light may be aimed at a reflector and the reflector may reflect a blended reflected light to a location of interest. The blended reflected light may be directed to one or more location so that transitions between other light sources are not visible, so that dark spots are not visible, or both.

The light, light assembly, light sources, reflectors, or a combination thereof may be adjusted or aimed by a method taught herein. The light may be directed to a surface and preferably a surface that is substantially normal to the light (e.g., a surface that is generally perpendicular to the ground, the light, or both (i.e., within ±5 degrees)). The light may be directed to a surface (e.g., a wall) that is perpendicular to the ground, the light, or both so that the light pattern is visible and the lights may be adjusted on the surface. A distance may be measured between the surface and the light source, vehicle, light assembly, or a combination thereof. The distance may be adjusted. A height from the ground may be measured. The light pattern may be identified on the surface. The light pattern may be moved to a predetermined location or a calculated location based upon a distance measured or an adjusted distance. The light pattern may be moved to an aimed position. Each of the light assemblies may be moved to an aimed position. Each light assembly may include one or more light sources and adjusting the light assembly may adjust all of the one or more light sources. Each light source and reflector combination may create a light pattern. Each light assembly regardless of the number of light sources and reflectors may have a single light pattern. Adjusting a single light pattern may align the entire light assembly. Light patterns of adjacent light assemblies may be moved so that the light patterns may located at a same height, in a same plane, or both. The light patterns of adjacent light assemblies may be moved so that the light patterns are spaced equidistant apart, are uniformly spaced, are spaced a predetermined distance based upon a location on a vehicle, or a combination thereof. The light pattern may be moved upon, down, left, right, or a combination thereof. The light pattern when adjusted may alight with a horizon so that the light pattern is not visible during use.

FIG. 1A illustrates a light system 2 of a vehicle 100 shown as a commercial vehicle (e.g., tractor). The light system 2 includes a light source 10 that forms a far light 14 and a near light 16. The far light 14 extends above the ground 80 at an angle (θ) and projects outward a first distance. The light source 10 forms a near light 16 that extends above the ground 80 at an angle (ϕ) and projects outward a second distance that is less than the first distance. Blended light 18 extends between the far light 14 and the near light 16 so that dark spots are not visible therebetween. A light pattern 50 is illustrated on a surface 82 within the near light 16 so that a user can adjust the light system 2.

Figure 1B:
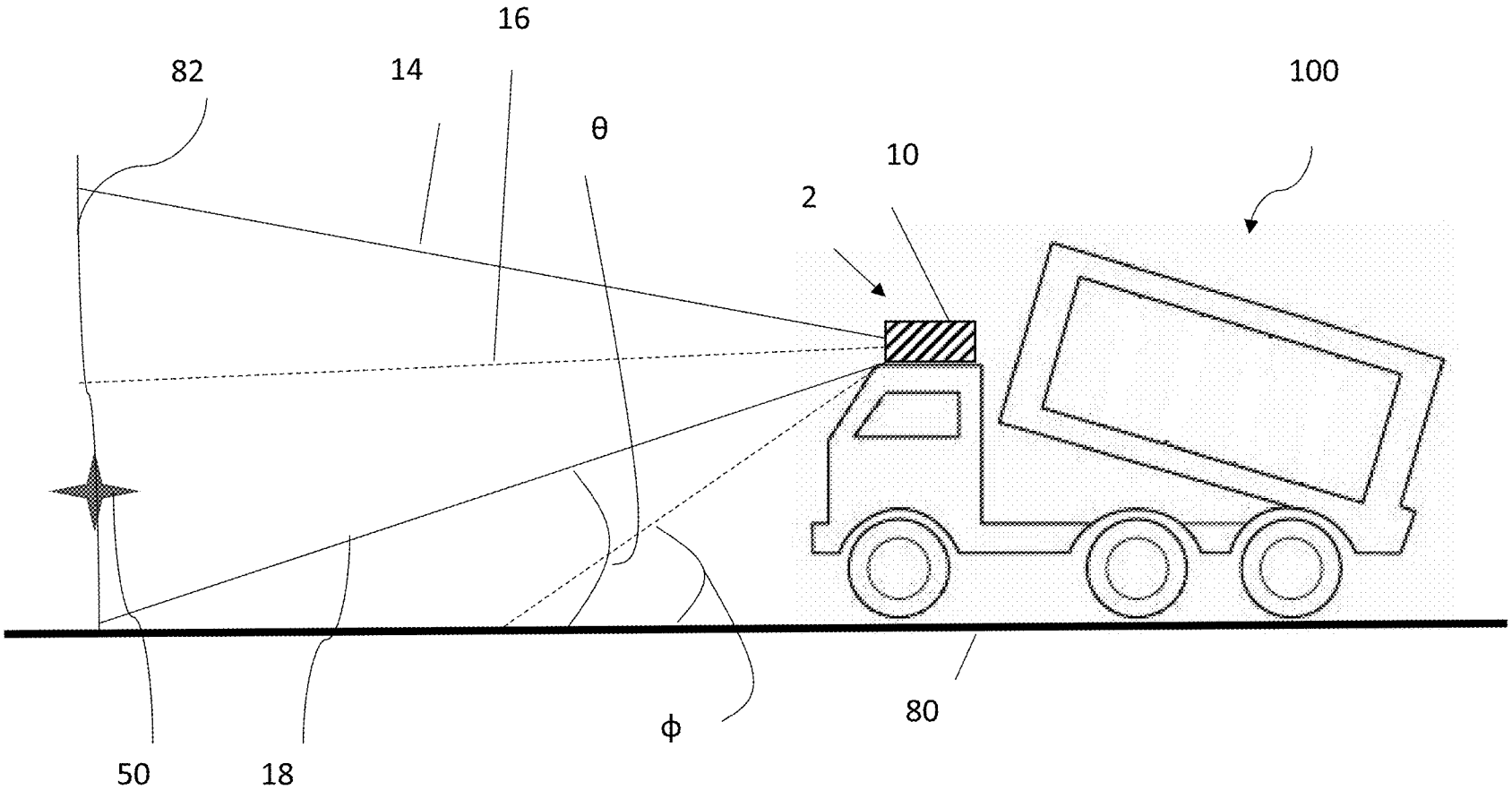
FIG. 1B is a side view of a vehicle with a light being directed in two locations.

FIG. 1B illustrates a light system 2 of a vehicle 100 shown as an industrial vehicle (e.g., dump truck). The light system 2 includes a light source 10 that forms a far light 14 and a near light 16. The far light 14 extends above the ground 80 at an angle (θ) and projects outward a first distance. The light source 10 forms a near light 16 that extends above the ground 80 at an angle (ϕ) and projects outward a second distance that is less than the first distance. Blended light 18 extends between the far light 14 and the near light 16 so that dark spots are not visible therebetween. A light pattern 50 is illustrated on a surface 82 within the near light 16 so that a user can adjust the light system 2.

Figure 2:
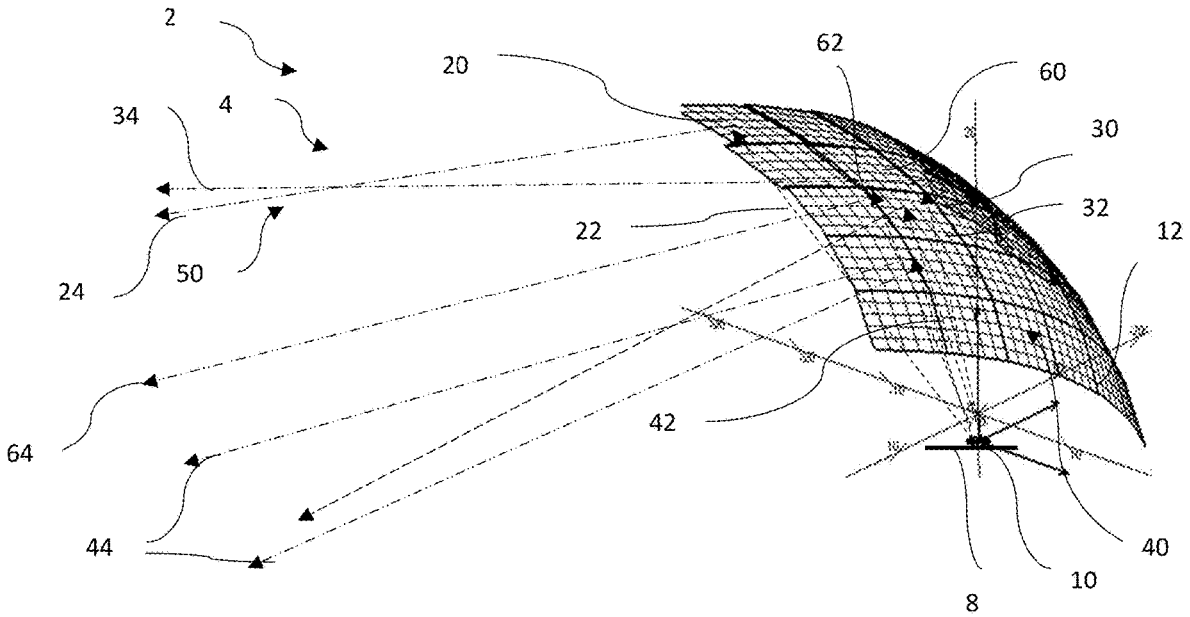
FIG. 2 is a side perspective view of the light system and light being reflected.

FIG. 2 is a side perspective view of one light assembly 4 of a light system 2. The light assembly 4 includes a printed circuit board 8 with a light source 10 (as shown the light source is a light emitting diode, but other light sources may be used) and a reflector 12. The reflector 12 includes a first reflector facet 20, a second reflector facet 30, a primary reflector facet 40, and a blended reflector facet 60. The first reflector facet 20 receives a first directed light 22 from the light source 10 and then directs the light along a path of first reflected light 24. The second reflector facet 30 receives a second directed light 32 from the light source 10 and then directs the light along a path of second reflected light 34. The first reflected light 22 and the second reflected light 32 extend at an angle relative to each other and as shown the first reflected light 22 and the second reflected light 32 cross to form a light pattern 50. The light source 10 directs a primary directed light 42 to a primary reflector facet 40 and then the primary reflector facet 40 directs the light along a path of primary reflected light 44 illuminating a desired location that is offset relative to the light pattern 50. As shown, a central region of the reflector 12 is the primary reflector facet 40 and is located below the first reflector facet 20 and the second reflector facet 30. The first reflector facet 20 and the second reflector facet 30 are angled relative to each other so that the first reflected light 24 and the second reflected light 34 form a light pattern 50. A blended reflector facet 60 received blended directed light 62 from the light source 10 and reflects back a blended reflected light 64 that assists in blending light between each of the facets to that dark spots are not formed in the light.

Figure 3:
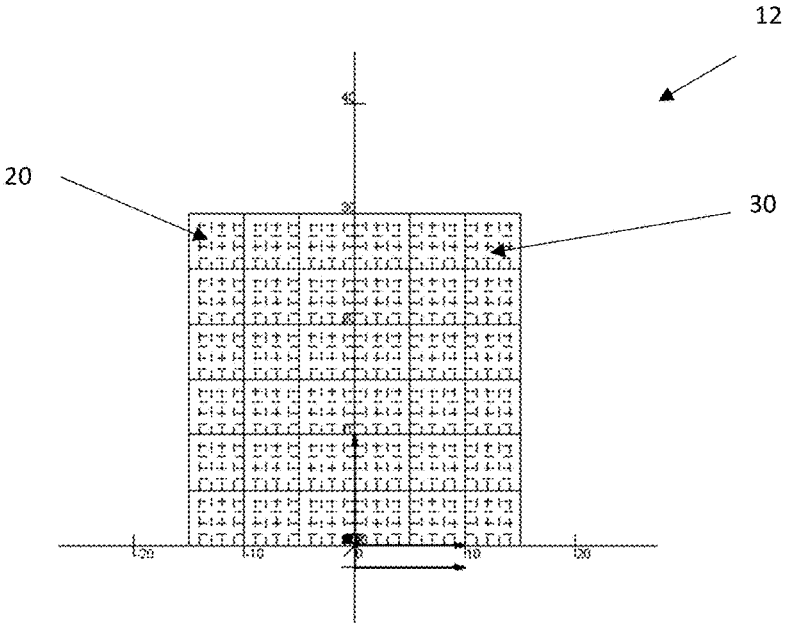
FIG. 3 is a front view of a reflector.

FIG. 3 is a front view of the reflector 12 and the shape of the reflector 12. The first reflector facet 20 and the second reflector facet 30 are angled inward to reflect the light (not shown) in a predetermined light pattern.

Figure 4:
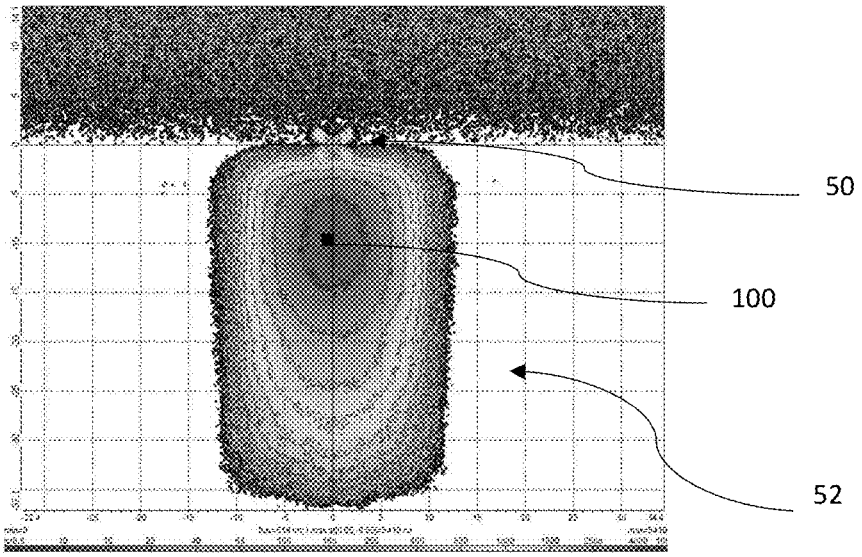
FIG. 4 is a top view of a light intensity pattern that includes a light pattern.

FIG. 4 illustrates a top view of a vehicle 100 and the light intensity pattern 52 including a light pattern 50 within the light intensity pattern 52. As shown, the light is more intense closer to the vehicle 100 and as the light is farther from the vehicle 100, the intensity decreases.

Figure 5:
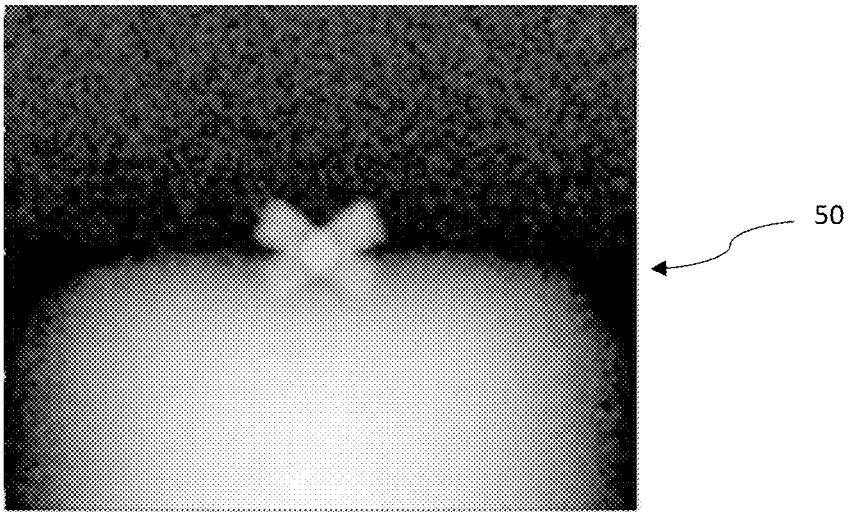
FIG. 5 is a top view of a light pattern.

FIG. 5 is a top view of a light pattern 50 with the light pattern 50 forming an "X" shape.

Figure 6:
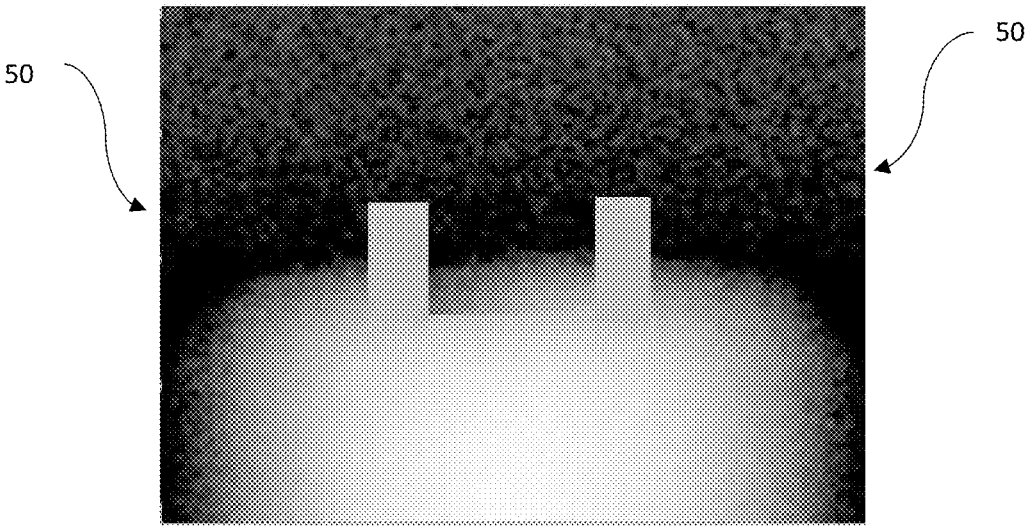
FIG. 6 is a top view of a light pattern.

FIG. 6 is a top view of a light pattern 50 with the light pattern 50 being two parallel rectangles.

Figure 7:
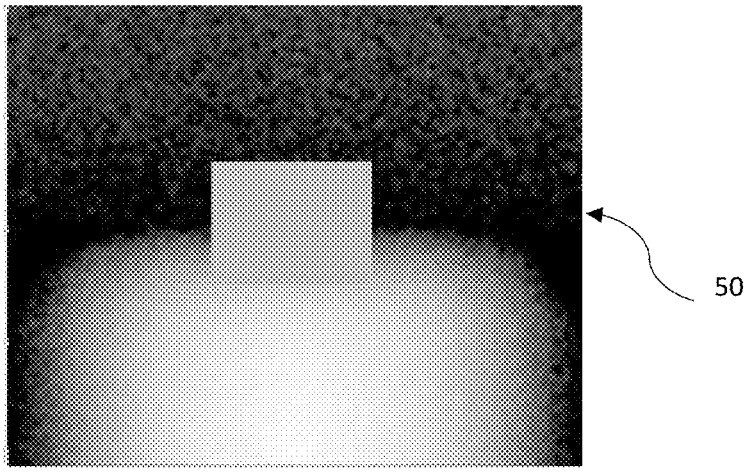
FIG. 7 is a top view of a light pattern.

FIG. 7 is a top view of a light pattern 50 with the light pattern 50 being a single rectangular shape.

Figure 8:
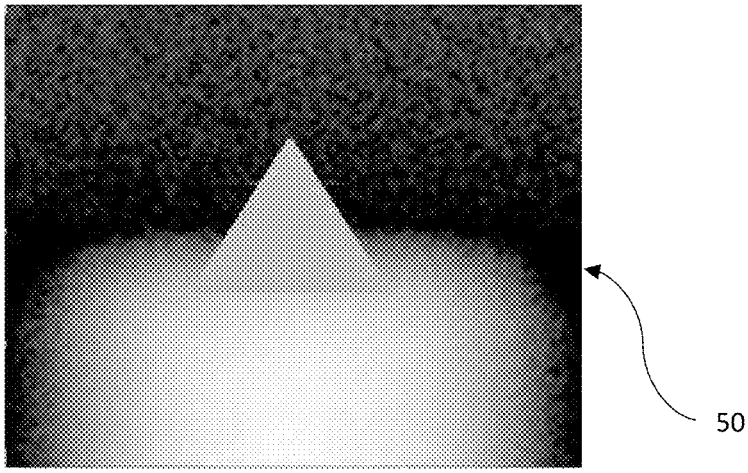
FIG. 8 is a top view of a light pattern.

FIG. 8 is a top view of a light pattern 50 with the light pattern 50 being a triangle.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

ELEMENT LIST

2 Light system
4 Light Assembly
8 Printed Circuit Board
10 Light Source
12 Reflector
14 Far Light
16 Near Light
18 Blended Light
20 First Reflector Facet
22 First directed light
24 First reflected Light

30 Second Reflector Facet
32 Second directed light
34 Second reflected light
40 Primary reflector facet
42 Primary directed light
44 Primary reflected light
50 Light Pattern
52 Light intensity Pattern
60 Blended reflector facet
62 Blended directed light
64 Blended reflected light
80 Ground
100 Vehicle

I claim:

1. A light assembly comprising:

a. one or more light sources; and b. one or more reflectors comprising:

i. a first reflector facet that forms a first reflected light by redirecting light from the one or more light sources in a first direction;

ii. a second reflector facet that forms a second directed light by redirecting light from the one or more light sources in a second direction; and iii. a primary reflector facet that directs light to a predetermined location to illuminate an area in a direction of travel of a vehicle housing the light assembly; and wherein the first directed light and the second directed light are directed to a location above the predetermined location and are configured to extend away from the vehicle to form a light pattern on a surface located a predetermined distance from the vehicle that demonstrates a location the light assembly is aimed relative to the vehicle so that movement of the light assembly moves the light pattern and a position of the light pattern assists in adjusting the light assembly; and wherein a light intensity for the first reflected light and the second reflected light are a different light intensity than the primary reflected light.

2. The light assembly of claim 1, wherein the one or more light sources are a single light source.

3. The light assembly of claim 1, wherein the one or more reflectors are a single reflector.

4. The light assembly of claim 1, wherein the primary reflector facet is located below both the first reflector facet and the second reflector facet and the primary reflected light extends in a direction under the first reflected light and the second directed light.

5. The light assembly of claim 4, wherein the light pattern when properly aimed is not visible during normal operation, when the vehicle is moving, or both as the light pattern is aligned with a horizon.

6. The light assembly of claim 5, wherein the light pattern is only visible when the first reflected light and the second reflected light are directed to a surface that is substantially perpendicular to the vehicle and the surface is located at a distance of about 5 m or more and a distance of about 50 m or less.

7. The light assembly of claim 1, wherein the one or more light sources is a single light source that generates a first directed light, which is directed to the first reflector facet, a second directed light that is directed to the second reflector facet, and a primary directed light that is directed to a primary reflector facet of the one or more reflectors.

8. A light system comprising:

a. two or more light assemblies each comprising:

i) reflectors in each of the two or more light assemblies, ii) light sources that directly project light towards the reflectors that reflect the light so that the light:

1. has a portion that extends in a first direction;

2. has a portion that extends in a second direction so that the light extending in the first direction and the light extending in the second direction are configured to form one or more light patterns on a surface located a predetermined distance from a vehicle housing the light system so that the one or more light patterns indicate an orientation of each of the two or more light assemblies relative to the vehicle and so that the light system is adjustable to direct light to illuminate a desired location when the vehicle is in operation; and 3. has a portion that extends in a primary direction that is different from the first direction and the second direction; and wherein a light intensity for a first reflected light extending in the first direction and a second reflected light extending in the second direction are a different light intensity than a primary reflected light extending in the primary direction; and wherein the light patterns are at least one of an "X", a square, triangle, lines, or a rectangle.

9. The light system of claim 8, wherein the light sources are a single light source in each of the two or more light assemblies.

10. The light system of claim 8, wherein the reflectors include a first reflector facet that forms the first reflected light that extends in the first direction and a second reflector facet that forms the second reflected light that extends in the second direction.

11. The light system of claim 8, wherein the primary direction forms an angle relative to a ground surface where some of the light in the primary direction is reflected onto the ground surface to an angle where some of the light extends generally parallel to the ground surface; and wherein the one or more light patterns extend above the primary direction.

12. A method comprising:

a. directing light from light assemblies of a light system comprising a first reflector facet, a second reflector facet, and a primary reflector facet away from a vehicle to a surface extending substantially perpendicular to a ground plane;

b. locating the vehicle, a predetermined distance from the surface;

c. locating a light pattern formed by the light assemblies on the surface; and d. moving the light assemblies so that the light assemblies are moved to an aimed position based on a position of the light pattern; and wherein a light intensity for a first reflected light from the first reflector facet and a second reflected light from the second reflector facet have a different light intensity than a primary reflected light from the primary reflector facet.

13. The method of claim 12, wherein the light assemblies are two light assemblies and each of the two light assemblies forms one of the light patterns.

14. The method of claim 13, wherein each of the light assemblies include one or more light sources and one or more reflectors and the create the light pattern by reflecting light from the one or more light sources to form the light pattern.

15. The method according to claim 12, comprising measuring a distance between the light assemblies and the normal surface and moving the light pattern to be located a predetermined height above a ground surface based upon the distance; and further comprising moving the light patterns so that the light patterns are spaced a predetermined distance apart.

16. The method according to claim 12, wherein the light patterns are at least one of an "X", a square, triangle, lines, or a rectangle.

17. The method according to claim 12, wherein a light intensity of the light pattern is different than a primary reflected light so that the light pattern is visible at the predetermined distance and the light pattern is not visible, is blurry, is out of focus, or a combination thereof when not located at the predetermined distance.

18. The light system according to claim 8, wherein when the vehicle is not located at the predetermined distance, the one or more light patterns are not visible, are blurry, are out of focus, or a combination thereof.

19. The light system according to claim 8, wherein the light system is configured to be located on a top of a tractor, combine, heavy equipment, farm equipment, industrial equipment, commercial equipment, or a combination thereof and project light in a forward direction, rear direction, and a side direction.

* * * * *